US008882991B2

(12) United States Patent
Kuechler et al.

(10) Patent No.: US 8,882,991 B2
(45) Date of Patent: Nov. 11, 2014

(54) PROCESS AND APPARATUS FOR CRACKING HIGH BOILING POINT HYDROCARBON FEEDSTOCK

(75) Inventors: Keith H. Kuechler, Friendswood, TX (US); Jennifer L. Bancroft, Houston, TX (US); Paul F. Keusenkothen, Houston, TX (US); Robert D. Strack, Houston, TX (US)

(73) Assignee: ExxonMobil Chemical Patents Inc., Houston, TX (US)

( * ) Notice: Subject to any disclaimer, the term of this patent is extended or adjusted under 35 U.S.C. 154(b) by 1254 days.

(21) Appl. No.: 12/545,470

(22) Filed: Aug. 21, 2009

(65) Prior Publication Data

US 2011/0042269 A1 Feb. 24, 2011

(51) Int. Cl.

| | |
|---|---|
| ***C10G 69/06*** | (2006.01) |
| ***C10G 9/38*** | (2006.01) |
| ***C10G 45/00*** | (2006.01) |

(52) U.S. Cl.

CPC ..... *C10G 69/06* (2013.01); *C10G 2300/42* (2013.01); *C10G 2300/107* (2013.01); *C10G 9/38* (2013.01); *C10G 2300/301* (2013.01); *C10G 2300/1059* (2013.01); *C10G 45/00* (2013.01)

USPC ..... 208/57; 208/61; 208/93; 208/130

(58) Field of Classification Search

USPC ..... 208/57, 61, 93, 94, 100, 130

See application file for complete search history.

(56) References Cited

U.S. PATENT DOCUMENTS

| | | | | |
|---|---|---|---|---|
| 3,617,493 | A | 11/1971 | Wirth et al. | |
| 4,065,379 | A | 12/1977 | Soonawala et al. | |
| 4,309,271 | A | 1/1982 | Dorner | |
| 5,443,715 | A | 8/1995 | Grenoble et al. | |
| 6,007,606 | A | 12/1999 | Baksh et al. | |
| 6,303,842 | B1 | 10/2001 | Bridges et al. | |
| 6,632,351 | B1 | 10/2003 | Ngan et al. | |
| 7,097,758 | B2 | 8/2006 | Stell et al. | |
| 7,138,047 | B2 | 11/2006 | Stell et al. | |
| 7,374,661 | B2 * | 5/2008 | Bridges et al. | 208/106 |
| 2006/0272982 | A1 * | 12/2006 | Montanari et al. | 208/86 |
| 2007/0090018 | A1 | 4/2007 | Keusenkothen et al. | |
| 2007/0090019 | A1 | 4/2007 | Keusenkothen et al. | |
| 2007/0090020 | A1 | 4/2007 | Buchanan et al. | |

FOREIGN PATENT DOCUMENTS

| | | |
|---|---|---|
| WO | 2004/005432 | 1/2004 |
| WO | 2005/095548 | 10/2005 |
| WO | 2005/113713 | 12/2005 |
| WO | 2005/113714 | 12/2005 |

(Continued)

*Primary Examiner* — Renee E Robinson

(57) ABSTRACT

In one aspect, the invention includes in a process for cracking a hydrocarbon feedstock comprising: a) feeding a hydrocarbon feedstock containing at least 1 wt % of resid components having boiling points of at least 500° C. to a furnace convection section to heat the feedstock; b) flashing the heated feedstock in a first flash separation vessel to create a first overhead stream and a first bottoms liquid stream; c) hydrogenating at least a portion of the first bottoms liquid stream to create a hydrogenated bottoms stream; d) flashing the hydrogenated bottoms stream in a second flash separation vessel to create a second overhead stream and a second bottoms liquid stream; e) cracking the first overhead stream and the second overhead stream in a cracking furnace to produce a pyrolysis effluent stream. In other embodiments, the process further comprises heating the hydrocarbon feedstock in step a) to a temperature within a range of from 315° C. to 705° C.

22 Claims, 1 Drawing Sheet

(56) References Cited

FOREIGN PATENT DOCUMENTS

| | | |
|---|---|---|
| WO | 2005/113715 | 12/2005 |
| WO | 2005/113716 | 12/2005 |
| WO | 2005/113717 | 12/2005 |
| WO | 2005/113718 | 12/2005 |
| WO | 2005/113721 | 12/2005 |
| WO | 2005/113722 | 12/2005 |
| WO | 2005/113723 | 12/2005 |
| WO | 2007008403 | 6/2006 |
| WO | 2007092844 | 2/2007 |

* cited by examiner

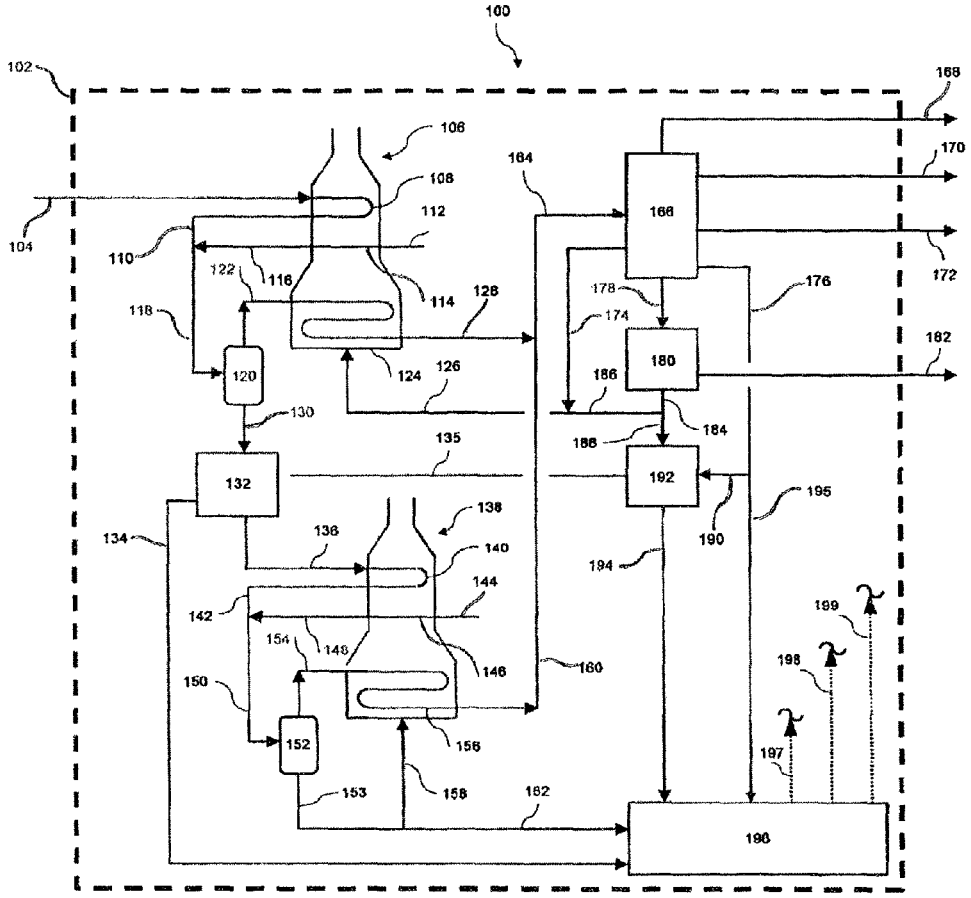
100
102
104
106
108
110
112
114
116
118
120
122
124
126
128
130
132
134
135
136
138
140
142
144
146
148
150
152
153
154
156
158
160
162
164
166
168
170
172
174
176
178
180
182
184
186
188
190
192
194
195
196
197
198
199

PROCESS AND APPARATUS FOR CRACKING HIGH BOILING POINT HYDROCARBON FEEDSTOCK

FIELD

This invention relates to a process and apparatus for converting high boiling point hydrocarbon feedstock into light unsaturated hydrocarbons, such as olefins. More particularly the invention relates to a process and apparatus for improving the quality and crackable percentage of high resid/nonvolatile-containing feedstocks (e.g., at least 1 wt % of resids) using a series of flash separation steps with intermediate hydrogenation, prior to radiant cracking.

BACKGROUND

Light olefins such as ethylene and propylene have traditionally been manufactured by cracking various hydrocarbon streams, ranging from gases such as ethane, to liquid fractions, including relatively low boiling point liquids such as naphtha to relatively high boiling point liquids such as gas oils. Gas oils typically have a final boiling point of up to 340° C. (650° F.), being derived typically from an atmospheric pipestill sidestream located just above the bottoms product. The atmospheric still bottoms product is commonly termed as "atmospheric resid" or "long resid." Atmospheric resid can be provided to a vacuum pipestill operating at lower hydrocarbon partial pressures, albeit at an additional economic cost to do so. The non-bottoms products of a vacuum pipestill may be referred to as "vacuum gas oils" and typically have a final boiling point of up to 650° C. (1050° F.). The bottoms product of a vacuum still is known commonly as "vacuum resid," "short resid," or "pitch."

Steam cracking ("cracking") generally entails heating hydrocarbon streams in the presence of steam (or other generally inert substance such as methane), in a steam cracking furnace, typically to a temperature in excess of about 370° C. (700° F.) and 25 psia. At such conditions, many of the hydrocarbon molecules undergo cracking, that is, the breaking of carbon-carbon bonds and/or releasing hydrogen from saturates to form ethylene and propylene, among other olefinic and aromatic products. Through undesirable side reactions, the furnace tubes will gradually accumulate carbonaceous deposits or "coke." Coke build-up eventually causes an unacceptable increase in furnace pressure drop and loss of heat transfer, and periodically the furnace must be taken out of service to undergo a steam-air decoking operation to remove the coke deposits from the inside of the tubes. Generally, the higher the final boiling point of the feedstock, the higher the content of species that increase the rate of coking in the furnace tubes, particularly asphaltenes or multi-ring aromatic species. Feedstocks having components with a final boiling point above 500° C. (932° F.) and even more so above 565° C. (1050° F.) can cause furnace run-lengths to drop to a week or less and are thus generally unacceptable as a feedstock. However, it is otherwise desirable to use such heavy feedstocks as cracker feed because they still contain a significant proportion of crackable components. Further, such feedstocks are typically inexpensive relative to lower boiling range counterparts (e.g., naphtha) and are readily available in some regions of the world. The challenge is to maximize the amount of crackable components while retaining an overall economic cost advantage. These motivations are also applicable to heavy feedstocks that have undergone minimal processing, such as non-processed whole crudes and atmospheric resids that avoided the expensive vacuum pipestill step and still contain substantial amounts of crackable molecules.

Thus, production of olefins from steam cracking of heavy hydrocarbon feedstocks remains an area of increasing industrial importance and methods have been disclosed for such. One such method involves introducing a flash operation within the convection sections of a pyrolysis furnace, where a heavy feedstock and steam mixture is preheated and separated. The overhead flash vapor of the heated mixture is then further heated to a higher temperature in the radiant section such that cracking occurs and olefins are produced. The flash operation produces a bottoms liquid product containing most of the problematic higher boiling point components that are not cracked. Such method is generally more efficient in providing useful, crackable molecules to the radiant section of the furnace than a typical vacuum pipestill operation, by virtue of the much higher steam content of the mixture in a pyrolysis furnace and the attendant lower hydrocarbon partial pressure in the flash operation. Useful methods and apparatus for conducting such flash operation are found for example in U.S. Pat. Nos. 6,632,351, 7,097,758, and 7,138,047. However, the liquid bottoms of such operations are typically very heavy and of particularly low value, suffering undesirable characteristics such as high viscosity and concentrated, high levels of sulfur, nitrogen, metals, or other undesirable inorganics.

Various methods have been contemplated to address this low-value bottoms product aspect, instructing one or more operations on the feedstock to make a higher percentage suitable for steam cracking. For example, U.S. Pat. No. 4,065,379 suggests thermally cracking an atmospheric resid stream at moderate temperatures, separating a gas oil stream from the product of the thermal cracking, catalytically hydrotreating the gas oil stream, and then steam cracking the hydrotreated gas oil stream. The beginning thermal cracking step generates a high viscosity secondary residue that is of lower quality than vacuum pipestill bottoms, which is disposed of as a fuel. Presently, such disposition is environmentally unacceptable and significant additional treatment or dilution with low sulfur, low viscosity materials would be required for use as a fuel.

As the art progressed, the issue of secondary bottoms residue was further addressed, but again directed some form of rather complex treatment of the feedstock prior to steam cracking. U.S. Pat. No. 4,309,271 refers to hydrogenation of a high boiling feedstock, optionally with fractionation to remove remaining high boiling components, and providing the distilled, hydrogenated materials to a steam cracker. U.S. Pat. No. 6,303,842 suggests hydrotreating and/or solvent deasphalting a heavy feedstock prior to stream cracking the appropriate fractions derived from the hydrotreating or deasphalting process. Note that solvent deasphalting also generates a high viscosity, high sulfur, asphaltene laden, environmentally challenged secondary residue that is difficult to use as a fuel. Similarly, U.S. Patent Applications 20070090018, 20070090019 and 20070090020 direct one to hydroprocess a heavy feedstock and provide the hydrogenated feedstock to a steam cracking furnace comprising a flash operation such as found in U.S. Pat. Nos. 6,632,351, 7,097,758, or 7,138,047, noted above. A secondary residue is generated as the flash liquid bottoms product that is of less environmentally challenged quality with a higher fuel value than the heavy feedstock that had not first been hydroprocessed. However, a significant problem with each of the above references is that they conduct one or more rather complex, costly treatments to the entire feed stream, which feed includes a great quantity of already useful, crackable material that derives little or no steam cracking benefit from such treatment and unnecessarily consume treatment feeds and resources such as hydrogen, steam, and heat.

In another attempt to overcome the above problems, U.S. Pat. No. 3,617,493 suggests reheating and flashing the liquid bottoms stream from a first flash separator in a second flash separator but otherwise does little to improve the ability of the second flash separator to improve the crackable fraction of the feed stream. Such arrangement produces a highly undesirable bottoms product from the second flash separation and does very little to upgrade the overall crackable quality of the feedstock or to prevent formation of asphaltenes, tars, and coke precursors. Still another problem confronting olefins producers is the increasing cost or in some instances simple unavailability of suitable fuel streams, particularly gaseous fuels streams required to power and operate a pyrolysis furnace, ancillary boiler furnaces, and other equipment.

SUMMARY

Advantageously, the present inventions provide methods and apparatus for steam cracking heavy feedstocks by efficiently treating only those fractions that most benefit from such treating. Also, the present inventions advantageously provide methods and apparatus that efficiently produce improved-value secondary residues and streams that may be utilized in the process to provide part or all of the fuel and hydrogen needs of the process. Further, the inventive processes serve to substantially upgrade crackable quality of the feedstock, facilitating not only improved crackable fraction of the feedstock, but also providing reduced tendency of the volatized fractions to form asphaltenes, tars, and coke precursors during cracking and quenching.

In one aspect, the invention resides in a process for cracking a hydrocarbon feedstock comprising: a) feeding a hydrocarbon feedstock containing at least 1 wt % of resid fractions having boiling points above 500° C. (932° F.) to a furnace convection section to heat the feedstock; b) flashing the heated feedstock in a first separation vessel to create a first overhead stream and a first bottoms liquid stream; c) hydrogenating at least a portion of the first bottoms liquid stream to create a hydrogenated bottoms stream; d) flashing the hydrogenated bottoms stream in a second separation vessel to create a second overhead stream and a second bottoms liquid stream; e) cracking the first overhead stream and the second overhead stream in a cracking furnace to produce a pyrolysis effluent stream. In other embodiments, the process further comprises heating the hydrocarbon feedstock in step a) to a temperature within a range of from 315° C. to 705° C. In many embodiments, the inventions may include the step of adding steam and/or water to at least one of the hydrocarbon feedstock and/or the hydrogenated bottoms stream. In yet other embodiments, the inventions optionally include the step of heating the hydrogenated bottoms stream to a temperature within a range of from 315° C. to 705° C. prior to flashing the heated hydrogenated bottoms stream. For example, the hydrogenated bottoms stream may be fed to a furnace convection section for such heating of the hydrogenated bottoms stream.

In other aspects, the inventions may include a process for cracking a hydrocarbon feedstock comprising: a) feeding a hydrocarbon feedstock containing at least 2 wt % of fractions having boiling points above 500° C. (932° F.) to a furnace convection section to heat the feedstock; b) flashing the heated feedstock in a first separation vessel to create a first overhead stream and a first bottoms liquid stream; c) hydrogenating at least a portion of the first bottoms liquid stream to create a hydrogenated bottoms stream; d) heating the hydrogenated bottoms stream; e) flashing the heated hydrogenated bottoms stream in a second separation vessel to create a second overhead stream and a second bottoms liquid stream; f) cracking the first and/or second overhead stream in a cracking furnace to produce a pyrolysis effluent stream; g) recovering steam cracked tar from the pyrolysis effluent stream; h) partially combusting at least a portion of a recovered steam cracked tar in a partial oxidation process to form a synthesis gas; i) recovering hydrogen from the synthesis gas and utilizing at least a portion of the hydrogen in step c) hydrogenation.

Advantageously, the invention may also include combusting at least a portion of the synthesis gas produced in step h) to provide thermal energy for use in the process of cracking a hydrocarbon feedstock. In another aspect, the invention includes apparatus for cracking a hydrocarbon feedstock, the apparatus comprising: a) a furnace convection section to heat a hydrocarbon feedstock containing at least 1 wt %, in some embodiments at least 2 wt %, of resid fractions having a boiling point of at least 500° C. or in other embodiments of at least 565° C.; b) a first separation vessel to flash the heated hydrocarbon feedstock to create a first overhead stream and a first bottoms liquid stream; c) a hydrogenation unit to hydrogenate at least a portion of the first bottoms liquid stream to create a hydrogenated bottoms stream; d) another separation vessel to flash the heated hydrogenated bottoms stream to create a second overhead stream and a second bottoms liquid stream; e) a cracking furnace to crack the first and/or second overhead streams to produce a pyrolysis effluent stream.

In other embodiments, the invention comprises at least one of the furnace convection section and another furnace convection section to heat the hydrogenated bottoms stream from the hydrogenation unit. The furnace convection section may be the same furnace convection section used to initially heat the hydrocarbon feedstock, or it may be another convection section, separate from the convection section that is used to initially heat the feedstock.

In other embodiments, the invention may include a partial oxidation unit to partially combust at least a portion of a steam cracked tar recovered from the pyrolysis effluent stream to form a synthesis gas. Such synthesis gas may be consumed as fuel for use in the cracking process, and/or for production of hydrogen for consumption in the hydrogenation process.

BRIEF DESCRIPTION OF THE DRAWING

FIG. 1 provides a simplified process flow diagram illustrating multiple embodiments of the invention.

DETAILED DESCRIPTION OF THE EMBODIMENTS

The terms "convert," "converting," "crack," and cracking" are defined broadly herein to include any molecular decomposition, breaking apart, conversion, dehydrogenation, and/or reformation of hydrocarbon or other organic molecules, by means of at least pyrolysis heat, and may optionally include supplementation by one or more processes of catalysis, hydrogenation, diluents, stripping agents, and/or related processes.

The term "resid" as used herein, includes hydrocarbon components having a final or end boiling point of 500° C. (932° F.), or in some embodiments at least 565° C. (1050° F.), or higher (e.g., including atmospheric resid and higher boiling compounds), and including the weight of non-volatizable fractions or components, such as metals. The inventive process and apparatus are suitable for use with substantially any hydrocarbon feedstock containing at least 1 wt % and preferably at least 2 wt % resid based upon the total weight of the feedstock, measured according to ASTM D2887. Examples of applicable feedstock include but are not limited to one or more of atmospheric resid, vacuum resid, steam cracked gas oil and residues, gas oils, heating oil, jet fuel, diesel, kerosene, gasoline, coker naphtha, steam cracked naphtha, catalytically cracked naphtha, hydrocrackate, reformate, raffinate reformate, Fischer-Tropsch liquids, Fischer-Tropsch gases, natural gasoline, distillate, naphtha, crude oil, crude blends, pitch, tars, asphaltenes, atmospheric pipestill bottoms, vacuum pipestill streams including side streams and bottoms, other distillate and fractionate bottoms, virgin naphtha, wide boiling range naphthas, heavy non-virgin hydrocarbon streams from refineries, vacuum gas oil, heavy gas oil, naphtha contaminated with crude, atmospheric resid, heavy residuum, C4's/residue admixture, condensate, contaminated condensate, naphtha residue admixture and mixtures thereof. At least a portion of the hydrocarbon feedstock may have a nominal end boiling point of at least 500° C. (932° F.), or of at least 350° C. (652° F.), or often at least 200° C. (392° F.), and will commonly have a nominal end boiling point of at least 260° C. (500° F.). Some preferred hydrocarbon feedstocks include but are not limited to crude oil, atmospheric resids, contaminated condensate, and gas oil distillates, tars, steam cracker tars, fuel oils, quench tower bottoms, cycle oils, and mixtures thereof. The vaporized hydrocarbon feed may be supplemented with substantially any other hydrocarbon co-feed material that undergoes the thermal cracking.

In many typical aspects, the hydrocarbon feedstock may contain at least about 1 wt %, 2 wt %, or 3 wt %, or 5 wt %, or 7 wt %, or 10 wt %, or 15 wt % of resid material boiling at a temperature of at least 500° C. (932° F.) or in other embodiments at or above 565° C. (1050° F.), according to ASTM D2887. In other embodiments, the feedstock may include at least about 5 wt %, or 10 wt %, or 15 wt %, or 20 wt %, or 25 wt %, or 35 wt %, or 50 wt % of material boiling at or above 340° C. (650° F.) according to ASTM D2887. In other embodiments, the feedstock may include at least about 1 wt %, or 2 wt %, or 3 wt %, or 5 wt % of resid material having boiling point of at least 650° C. (1200° F.) according to ASTM D2887. In other embodiments, the feedstock may have an API gravity according to ASTM D4052 of no greater than about 35.0, or 32.0, or 30.0, or 28.0, or 25.0, or 20.0, or 15.0. In still other embodiments, the feedstock may have sulfur content according to ASTM D2622 at least about 0.2 wt %, 0.5 wt %, or 1.0 wt %, or 1.5 wt %, or 2.0 wt %, or 3.0 wt %, or 4.0 wt %. Directionally, the invention may become more advantaged with feedstocks having higher sulfur contents, which benefit from the concentration thereof in the first flash liquid bottoms stream provided to hydrogenation. The feedstock may also comprise pentane insolubles according to ASTM D893 of at least 0.5 wt %, or 1.0 wt %, or 1.5 wt %, or 2.0 wt %, or 3.0 wt %, or 5.0 wt %, or 10.0 wt %. In some embodiments, the feedstock may have Conradson Carbon according to ASTM D2622 of at least 0.5 wt %, or 1.0 wt %, or 1.5 wt %, or 2.0 wt %, or 3.0 wt %, or 5.0 wt %, or 7.0 wt %, or 10.0 wt %.

In some aspects, the feedstock may have a hydrogen content according to ASTM D4808 of no greater than 14.0 wt %, or 13.5 wt %, or 13.0 wt %, or 12.9 wt %, or 12.8 wt %, or 12.7 wt %, or 12.6 wt %, or 12.5 wt %, or 12.4 wt %, or 12.3 wt %, or 12.2 wt %, or 12.1 wt %, or 12.0 wt %, or 11.9 wt %, or 11.8 wt %, or 11.7 wt %, or 11.6 wt %, or 11.5 wt %. In other aspects, the feedstock may include or substantially comprise a whole crude oil, an atmospheric residuum, or blend thereof. There may be other components present, such as nitrogen according to ASTM D4629, metals such as vanadium and nickel measured by atomic absorption, seawater and sediment, the latter two which are preferably removed by means well known to the skilled artisan as received in (a) or prior to adding water and heating (b).

Preferably, the hydrocarbon feedstock is heated and diluted with steam and/or water, such as by feeding the feedstock into the convection section of a steam cracking furnace and therein introducing water and/or steam into the hydrocarbon stream, such as with a sparger. As used herein, the term water includes liquid water, vapor water (also called steam) and combinations thereof. However, in some alternative embodiments it may be desirable not to add steam to the hydrocarbon feedstock. The water and heat may be added in any convenient fashion to arrive at the stipulated hydrocarbon/steam mix ratios, partial pressures, or conditions. A useful method may be derived from U.S. Pat. No. 7,138,047 (ExxonMobil) wherein the water and heat is added in an integrated pyrolysis furnace apparatus, incorporated herein by reference.

When added, the proportion of steam (water) in the steam/hydrocarbon mix, on a weight of steam to weight of hydrocarbon feedstock basis, may be at least 0.10 and no greater than 2.0, or at least 0.20 and no greater than 1.0, or at least 0.25 and no greater than 0.60. In general, the higher the proportion of 565° C.+ (1050° F.+) material, a directionally higher proportion of steam is desired. The temperature of the heated hydrocarbon or the steam/hydrocarbon mix may be at least 315° C. (600° F.) and no greater than 650° C. (1200° F.), or at least 315° C. (600° F.) and no greater than 540° C. (1000° F.), or at least 370° C. (700° F.) and no greater than 495° C. (920° F.), or at least 400° C. (750° F.) and no greater than 480° C. (900° F.), or at least 430° C. (810° F.) and no greater than 475° C. (890° F.). The pressure of the mix may be at least 138 kPaa (20 psia) and no greater than 2068 kPaa (300 psia), or at least 207 kPa (30 psia) and no greater than 1724 kPa (250 psia), or at least 276 kPa (40 psia) and no greater than 1379 kPa (200 psia), or at least 587 kPa (85 psia) and no greater than 1069 kPa (155 psia), at least 724 kPa (105 psia) and no greater than 1000 kPa (145 psia), at least 724 kPa (105 psia) and no greater than 862 kPa (125 psia).

Preferably, the ratios and conditions of the mix are correlated to cause the hydrocarbon in the water/hydrocarbon mix to be in both the liquid and vapor phases/streams. Conveniently, at least 20 wt % of the hydrocarbon in either water/hydrocarbon mix is in the liquid phase/stream, as measured by the liquid and vapor rates emanating from either flash vessel following introduction of the water/hydrocarbon mix, or at least about 25 wt %, or 30 wt %, or 35 wt %, or 40 wt %, or 50 wt %, with the balance in the vapor phase/stream. Alternatively, no greater than about 90 wt % of the hydrocarbon in either water/hydrocarbon mix is in the vapor phase/stream, as measured by the liquid and vapor rates emanating from either flash drum following introduction of the water/hydrocarbon mix, or no greater than about 85 wt %, or 80 wt %, or 75 wt %, or 70 wt %, or 65 wt %, or 60 wt %, with the balance in the liquid phase/stream. Generally, almost all of the water in either water/hydrocarbon mix is in the vapor phase/stream (as steam), for example, at least 95 wt %, or at least 99 wt %. The small balance typically may be in the flash liquid bottoms streams.

In many embodiments, the hydrocarbon feedstock is fed to a steam cracking furnace. Typically, such furnaces include a convection section for convection heating the hydrocarbon feedstock within one or more tube banks, and a radiant section for pyrolysis cracking or radiant heating and cracking of the effluent within a radian tube bank. Such furnaces are well known within the cracking industry. Preferably, the steam cracking furnace is a liquid feedstock cracker, although in some alternative embodiments the cracker may be a gas cracker such as used to crack an ethane feedstock that is modified or otherwise adjusted for cracking a liquid feedstock.

The flashing in either the first separation vessel (drum) and/or the second separation vessel, (e.g., vapor/liquid separation, typically not requiring or associated with any substantial concurrent pressure drop or reduction, but in some embodiments a concurrent flashing pressure reduction may also be provided to assist the flash separation) may be conducted in any convenient fashion or apparatus to provide the flash liquids and vapors. One useful method may be derived from U.S. Pat. No. 7,138,047 wherein the flashing is conducted along with the addition of water and heat to the feedstock in an integrated pyrolysis furnace apparatus, incorporated herein by reference. The temperature within the flash drums, and hence the flash liquids and vapors, may be the same ranges as the temperature of the mixes described above, or the same ranges described above less about 1° C. (1° F.). The pressure within the flash drums and hence the flash liquids and vapors, may be the same ranges as the mixes described above, the same ranges described above less about 7 kPa (1 psia).

The inventive process includes the step of hydrogenating at least a portion and preferably the entirety of the first flash or separation vessel bottoms liquid stream to create a hydrogenated bottoms stream. The hydrogenation may be conducted by any one of a number of methods well known to those skilled in the art. A number of exemplary, useful methods may be derived from U.S. patent application Ser. No. 11/581,882, filed Oct. 17, 2006 and incorporated herein by reference. Preferably, the hydrogenation step used is a form of what is known in the art as "residfining," as opposed to what is known as "hydrocracking." In the latter, conditions and catalysts are selected to promote a substantial amount of ring opening of various aromatic species and saturation of a high percentage or substantially all species in the feedstock or formed from such ring opening, wherein the hydrogen consumption is relatively high. In the preferable former, conditions and catalysts are selected to focus on the reduction of heteroatoms, such as sulfur and nitrogen, and while some saturation may occur, there is relatively little ring opening and the hydrogen consumption is relatively low as compared to hydrocracking (about ½ that of hydrocracking).

The consumption of hydrogen in the processing of the first flash liquid bottoms, that is, the amount of hydrogen consumed or incorporated into the hydrogenation product as the net difference between the amount of hydrogen fed and the amount of hydrogen unreacted, is at least about 100 SCF per barrel of feedstock (100 SCF/bbl×0.026853 NCM (normal cubic meters)/SCF×1 bbl/159 liters=0.01689 NCM/liter (at 60° F. (15.6° C.) and 14.73 psi (101.6 kPa))) but no greater than about 1500 SCF per barrel (0.25333 NCM/l) of feedstock, or at least about 200 SCF/bbl (0.03378 NMC/l) and no greater than about 1200 SCF/bbl (0.20266 NCM/l), or at least about 300 SCF/bbl (0.05067 NCM/l) and no greater than about 1000 SCF/bbl (0.16889 NCM/l), or at least about 400 SCF/bbl (0.06755 NCM/l) and no greater than about 800 SCF/bbl (0.13511 NCM/l), or at least about 500 SCF/bbl (0.08444 NCM/l) and no greater than about 750 SCF/bbl (0.12667 NCM/l). The difference between the hydrogen content of the hydrogenated bottoms stream from the hydrogenation unit that is provided to the second flash separator and the hydrogen content of the first flash bottoms liquid stream from the first flash separator vessel that is fed to the hydrogenation unit, is in the range of from at least 0.5 wt % and no greater than 3.0 wt %, or in some embodiments at least 1.0 wt % and no greater than 2.8 wt %, or in still other embodiments at least 1.5 wt % and no greater than 2.6 wt %, higher than the hydrogen content of the first bottoms liquid stream before hydrogenation.

The hydrogenation product from the hydrogenation process is flashed in a second flash separation vessel to create a second overhead stream and a second bottoms liquid stream. Optionally, the hydrogenation product stream may be heated, such as in a convection section prior to the second flash separation. Also optionally, the hydrogenation product stream may be diluted by addition of steam or water (such as during optional heating in the convection section) prior to flash separation in the second flash vessel.

The extent of sulfur removal in the hydrogenation process, the amount and conditions of optional steam and optional heat addition to the hydrogenation product stream, and the second flash vessel temperature and pressure may be correlated to produce a second flash liquid bottoms stream in the second flash vessel comprising no greater than 3.5 wt % sulfur, or no greater than 3.0 wt % sulfur, or no greater than 2.5 wt % sulfur, or no greater than 1.5 wt % sulfur, or no greater than 1.0 wt % sulfur, or no greater than 0.5 wt % sulfur. Alternatively, the second flash liquid bottoms stream may comprise at least about 0.1 wt % and no greater than about 3.5 wt % sulfur, or at least about 0.1 wt % and no greater than about 1.0 wt % sulfur, or at least about 0.2 wt % and no greater than about 3.0 wt % sulfur, or at least about 0.3 wt % and no greater than about 2.5 wt % sulfur, or at least about 0.4 wt % and no greater than about 2.0 wt % sulfur or at least about 0.5 wt % and no greater than about 1.5 wt % sulfur. In another aspect, the extent of hydrogenation, conditions of optional steam and/or heat addition, and conditions of second flash temperature and pressure may be correlated to produce a second flash liquid bottoms stream having a kinematic viscosity at 100 C, via ASTM D445, or of at least 15.0 and no greater than 50.0 $mm^2/s$, or of at least 9.0 and no greater than 14.9 $mm^2/s$, or of least 5.0 and no greater than 8.9 $mm^2/s$. In still another embodiment, the conditions of optional water and heat addition and second flash temperature may be correlated such that the second flash liquid bottoms has a flash point temperature according to ASTM D93—Proc. B, of at least about 60° C.

The first and/or second overhead stream(s) from the flash separation vessels may optionally be further heated prior to feeding to a radiant section of a cracking furnace for thermal cracking to produce a pyrolysis effluent stream. In some embodiments, the means for optional steam addition and optional heating (both preferable) may be provided with the means for pyrolysis cracking in an integrated apparatus. The exit temperature of the pyrolysis cracking system, e.g., the temperature of the pyrolysis effluent stream, may be at least about 730° C. (1350° F.) and no greater than about 980° C. (1800° F.), or least about 760° C. (1400° F.) and no greater than about 925° C. (1700° F.), or least about 785° C. (1450° F.) and no greater than about 870° C. (1600° F.). Residence time of the flash liquid vapor stream(s) in the pyrolysis cracking exposed to at least 1300° F. may be at least 0.001 and no greater than 10.0 seconds, or at least 0.010 and no greater than 1.00 seconds, or at least 0.050 and no greater than 0.50 seconds. In many embodiments, each of the first flash overhead vapor stream and second flash overhead vapor stream are cracked in separate devices. Thus, the conditions for each may be optimized individually.

In many embodiments according to the present invention, at least a portion of the second flash liquid bottoms stream is further processed if needed and combusted and/or otherwise recovered for use in the overall process for producing the pyrolysis effluent stream and associated products (e.g., ethylene, propylene, etc.). Processes or components of the overall cracking system that may utilize portions of the second flash liquid bottoms stream for combustion include but are not limited to: the hydrogenation process and sub-processes conducting hydrogenation; auxiliary boilers that produce steam; cracking furnace burners; generators and turbines that produce one or more of the group selected from electricity, steam, hot flue gas, cogeneration electricity, heat for other heating purposes, and compression energy/drive energy, such as for an air compressor as needed to produce oxygen in an air separation unit to operate the partial combustion/oxidation, or a for a pyrolysis cracking effluent compressor as needed for cryogenic processes and efficient recovery of olefins such as ethylene, propylene, and/or other pyrolysis products.

At least a portion of or alternately the entire stream of second flash bottoms liquid stream may be combusted in a boiler to produce steam. Such steam produced by any means may be utilized in the overall process for making and recovering the pyrolysis products. Elements of the overall process that use such steam may include but are not limited to dilution steam for the hydrocarbon feed, turbine generators/expanders to produce electricity, turbines/expanders as a prime mover for pumps and compressors, reboilers for fractionation towers, desalination boilers for water production plants, cold weather tracing, and any number of other system elements required to produce ethylene and propylene in a safe and environmentally acceptable manner. A boiler, a pyrolysis furnace, or any equipment combusting the second flash liquid may be equipped with means to remove sulfur that may be contained in the combustion flue gas down to environmentally acceptable levels prior to discharging such flue gas to the atmosphere.

In many other aspects the present invention also includes the ability to produce a synthesis gas from the non-cracked, liquid bottoms fraction. The synthesis gas then may be consumed as fuel and or further processed to recover useful fractions such as hydrogen for use in the hydrogenation process. In many embodiments, steam cracked tar is produced within or is a component of the furnace pyrolysis effluent stream. A steam cracked tar steam is recovered from the pyrolysis effluent stream. In some embodiments, the recovered steam cracked tar stream may be partially combusted (partial oxidation, or "POX") such as in a POX unit to form a synthesis gas. Methods of recovering steam cracked tar from a steam cracker pyrolysis effluent stream, as well as characterization of steam cracker tar, are known to those skilled in the art. Means for such recovery and characterization are described, for example in U.S. Pat. No. 5,443,715 and U.S. patent application Ser. No. 11/177,076 filed Jul. 8, 2005, both incorporated herein by reference. Methods of producing synthesis gas by partial oxidation of heavy liquid hydrocarbon streams such as steam cracked tar are also known to those skilled in the art. Synthesis gas generation systems are capable of producing substantial volumes of steam at various pressures and temperatures. Such steam may be used within the synthesis generation systems, or for any other purpose in the overall process for making ethylene and propylene, many of which are given in detail below.

In many other aspects of the present invention hydrogen may be recovered from the production of synthesis gas, whereby the recovered hydrogen may be utilized in the process of hydrogenating the first bottoms liquid stream from the first flash separation vessel. Methods of producing hydrogen from synthesis gas are known to those skilled in the art. For example, a membrane system may be utilized or a pressure swing adsorption system. The synthesis gas also may be subjected to a "water-gas shift" reaction to produce additional hydrogen via conversion of CO and water contained in the synthesis gas to hydrogen and carbon dioxide. Methods for such shift reaction are known to those skilled in the art. Hydrogen containing tail gases found in or separated from the pyrolysis cracking effluent also may be added to the synthesis gas or water-gas shifted synthesis gas as additional recovered hydrogen. At least about 20 wt % of the hydrogen in the synthesis gas, water-gas shifted synthesis gas, or blend of such with hydrogen containing tail gases is recovered. Alternatively, at least about 30 wt %, or 40 wt %, or 50 wt %, 60 wt % is recovered. Conveniently, no greater than about 90 wt %, or no greater than about 80 wt % of the available hydrogen is recovered. An unrecovered-hydrogen containing stream or other component stream containing combustible gases, as may be generated in the recovery of hydrogen, may be used in the same manner described for synthesis gas and/or tail gas below. The hydrogen produced and/or recovered may be in the form of a stream containing at least about 60 mol %, or 70 mol %, or 80 mol %, or 90 mol %, or 99 mol % hydrogen. The balance of the stream may contain, for example, methane, ethane, or carbon dioxide, among other components. It is generally very low in carbon monoxide, say no greater than about 100 mol ppm, or no greater than about 10 ppm, or no greater than about 1 mol ppm, as that component is generally detrimental to the processes that use the hydrogen. Elements of the overall process for producing olefins that use hydrogen may include, but are not limited to, the hydrogenation process, partial or full saturation of acetylenes and diolefins found in or separated from the pyrolysis cracking effluent, partial or full saturation of C4+ olefins found in or separated from the pyrolysis cracking effluent, and/or the removal of sulfur found in the pyrolysis effluent, or olefin rich, aromatics rich or fuel liquid streams separated therefrom. Excess hydrogen beyond such reaction needs may be used for combustion according to the description of synthesis gas, below.

Hydrogen produced from the syngas and optionally the recovery tail gas(es) found in or separated from the pyrolysis cracking effluent, or any other tail gases, such as recycled from the hydrogenation system, satisfies all of the hydrogen requirements in the overall process for producing ethylene and propylene. No additional hydrogen or hydrogen rich streams need be formed within the overall process, or imported from outside the overall process as may be produced by other parties or processes. Elements of the overall process that may use the synthesis gas for combustion include, but are not limited to, the sub-process conducting hydrogenation; an auxiliary boiler that produces steam; a pyrolysis furnace; a gas turbine generator that produces one or more of the group selected from electricity, steam, hot flue gas for other heating purposes, and compression energy/drive energy, for example, an air compressor as needed to produce oxygen in an air separation unit to operate the partial combustion/oxidation, or a pyrolysis cracking effluent compressor as needed for efficient recovery of ethylene and propylene. Such steam that is produced may be utilized in the overall process for making ethylene and propylene. Elements of the overall process that use such steam may include, but are not limited to, dilution steam for the hydrocarbon feed, turbine generator/expanders to produce electricity, turbine expanders as a mover for pumps and compressors, reboilers of fractionation towers, boilers of desalination water production plants, cold weather tracing, and any number of other elements required to produce ethylene and propylene in a safe and environmentally acceptable manner. As noted above, recovery tail gas(es) as may be found in or recovered from the pyrolysis cracking effluent, or an unrecovered hydrogen containing stream or other component stream containing combustible gases as may be generated in the recovery of hydrogen, may be used in the same manner as synthesis gas, either separately or in any combination. The combustion of said second flash liquid bottoms stream, said synthesis gas, and recovery tail gases found in or separated from said pyrolysis cracking effluent, and optionally unrecovered hydrogen or other component stream containing combustible gases, or tail gases produced in other processes in the overall process for making ethylene and propylene, such as purge hydrogen from the hydrogenation system, satisfies at least 70%, or 80%, or 90% or 100% (all) of the combustion/heat/energy generation requirements of the overall process of producing the ethylene and propylene containing pyrolysis effluent stream, from the hydrocarbon feedstock containing at least 1 wt % of resid fractions having an end boiling point of at least 500° C.

In many aspects, it is a benefit of the present inventions that no additional fuel such as methane or LPG, or heat containing streams such as steam, or energy intensive process streams such as purified hydrogen or purified oxygen for the partial oxidation process, are imported from outside the overall process as may be produced or supplied by other parties or processes. The cracker system feedstock is often the only fuel or energy intensive process stream brought into the overall process for making ethylene and propylene of the present invention. The overall process for producing a pyrolysis effluent stream comprising ethylene and propylene may be expanded to become an overall process for making polyolefins from such ethylene, propylene or both, e.g., polyethylene and/or polypropylene materials. The overall process for producing the pyrolysis effluent stream comprising olefins also may be expanded to include a process for making aromatic byproducts in addition to olefins, or in addition to polyethylene or polypropylene, or to make all such products. Aromatic byproducts may include but are not limited to benzene, toluene, paraxylene, orthoxylene, mixed xylenes, mixed C9 aromatics, or naphthalene, in sales grade purities or as useful concentrates for further processing to sales grade materials.

In still other aspects of the invention, it may be a benefit that as the number of process elements and/or products contained in the overall process for producing the pyrolysis effluent stream and constituent products increases, the more advantageous traditionally lower quality, lower priced feedstocks become. For example, lower hydrogen containing feedstocks become more convenient, as opposed to traditional processes that almost invariably benefit from higher hydrogen containing feedstocks. The lower hydrogen containing feedstocks provide additional second flash liquid bottoms and steam cracked tar as desired according to the inventive processes, whereas such streams would otherwise be disadvantageous in traditional processes.

Referring to FIG. 1, exemplary overall process 100 of producing a steam cracker pyrolysis effluent stream comprising one or more product streams such as olefins and/or aromatics may include one or more of the numerous components, processes, equipment items and/or unit operations such as illustrated within boundary 102. Many of the generalized items and materials necessary to make the products come into the overall process through boundary 102, which includes a hydrocarbon feedstock in line 104 and may also include fuels, chemicals, and utilities such as electricity, raw water and the like that are not illustrated.

The feedstock in line 104 comprises hydrocarbons with at least about 2 wt % of material boiling at or above 500° C. (932° F.) or in other embodiments at or above 565° C. (1050° F.) according to ASTM D2887, is provided to first pyrolysis furnace 106, where heat is provided to increase the feedstock temperature in convection section coil 108 located in the convection section in the upper portion of first pyrolysis furnace 106, and the heated feedstock exits the first pyrolysis furnace 106 in line 110. Water/steam optionally but preferably may be provided to the first pyrolysis furnace 106 via line 112, vaporized and superheated in coil 114 in the convection section in the central portion of first pyrolysis furnace 106, and the superheated water exits in line 116, where it joins with the heated feedstock in line 110. The heated steam/hydrocarbon mix may be heated to a temperature within a range of from 315° C. (600° F.) up to 705° C. (1300° F.), is passed through line 118 to first flash drum or separation vessel 120, within which a first flash vapor overhead stream is generated and exits first flash drum 120 via line 122, and also within which a first flash bottoms liquid stream is generated and exits first flash drum 120 in line 130.

In one embodiment, not shown in FIG. 1, liquid water or steam may be added to the feedstock in line 104 instead of or in addition to the steam provided in line 116. Liquid water or steam may be added to the feedstock or the heated feedstock, and heat may be added to the feedstock, heated feedstock, or the liquid water/feedstock or steam/feedstock mix at any or many points, and in a variety of fashions in the method of the present invention, so long as the heated water/hydrocarbon mix has the conditions stipulated herein upon introduction to first flash drum 120. Alternatively, in another embodiment not shown in FIG. 1 steam and heated feedstock, or steam and heated steam/feedstock mix may be provided separately to first flash drum 120 in the method of the present invention, so long as the heated water/hydrocarbon mix has the conditions stipulated herein within first flash drum 120.

Continuing with FIG. 1, the first flash drum liquid bottoms in line 130 is provided to hydrogenation system 132 for hydrogenation, such as whereby the stream is catalytically reacted with hydrogen from a hydrogen enriched stream in line 135 provided to hydrogenation system 132, to produce a hydrogenated bottoms stream in line 136. Conveniently, the hydrocarbon in hydrogenated liquid stream in line 136 is depleted of heteroatoms, such as sulfur, nitrogen, oxygen and metals, and increased in hydrogen content, relative to the hydrocarbon in first flash liquid bottoms stream in line 130. In addition, other materials are removed in line 134 and provided for further use or processing in utility system 196. The materials in line 134 may contain unreacted hydrogen tail gas further containing inert light hydrocarbons purged to maintain appropriate hydrogen partial pressures in hydrogenation system 132; hydrogen sulfide and other sulfur containing molecules; ammonia; water; water containing some hydrocarbon, sulfur, or nitrogen; metals contained with a hydrocarbon purge stream or adhering to spent/deactivated catalyst; and/or a host of other materials as needed for the proper operation of hydrogenation system 132.

It is to be understood that, within the scope of the present invention, the materials in line 134 may be removed from hydrogenation system 132 in a number of different, discrete lines not shown in FIG. 1 according to the purpose and composition of the streams in such lines as is convenient to the particular configuration and proper operation of hydrogenation system 132. Such materials in such lines may be provided to the utility system 196 or otherwise provided to appropriate dispositions within or without boundary 102. For example, it may be beneficial to provide a purge stream comprised mainly of unreacted hydrogen and light hydrocarbons to hydrogen recovery unit 192 to recover additional hydrogen for use in the overall process of making ethylene and propylene 100. In addition, other materials may be provided to hydrogenation system 132 as needed for its proper operation not shown in FIG. 1, such as cooling water, dosing chemicals and the like. This is the case with all equipment and unit operations described in FIG. 1, or otherwise present but not described in FIG. 1, as may be needed in the overall system 100.

Returning to FIG. 1, hydrogenated liquid stream 136 is provided to a second flash vessel 152 for further flashing of the hydrogenated bottoms stream 136. In many embodiments, hydrogenated liquid stream 136 is first further heated prior to flashing, such by sending the hydrogenated liquid stream 136 to a pyrolysis furnace, such as in first pyrolysis furnace 108 or into second first pyrolysis furnace 138, where heat is added to the hydrogenated liquid stream 136 to increase the hydrogenated liquid stream temperature in coil 140 located in the convection section in the upper portion of second pyrolysis furnace 138, with the heated hydrogenated liquid stream exiting the second pyrolysis furnace 138 via line 142. Water is preferably provided to the pyrolysis furnace 138 via line 144, vaporized and superheated in coil 146 in the convection section in the central portion of second pyrolysis furnace 138, and the superheated water exits in line 148 and is combined with the heated hydrogenated liquid stream in line 142. The heated steam/hydrocarbon mix, at a temperature of at least about 315° C. (600° F.) and no greater than about 700° C. (1300° F.), is passed via line 150 to second flash drum 152, within which a second flash vapor overhead stream is generated and exits second flash drum 152 in line 154, and also within which a second flash liquid bottoms stream is generated and exits second flash drum 152 via line 153. In many embodiments, at least a portion of the second bottoms liquid stream 153 may be consumed as fuel in the process 100, such as for supporting the various steps of feeding the feedstock to the furnaces, separation processes, and hydrogenation processes, cracking processes, utilities processes, as well as other components of the system processes within system boundary 102.

In one embodiment, not shown in FIG. 1, liquid water or steam may be added to the hydrogenated liquid stream in line 136 instead of or in addition to the steam provided in line 148. Liquid water or steam may be added to the hydrogenated liquid stream or the heated hydrogenated liquid stream, and heat may be added to the hydrogenated liquid stream, heated hydrogenated liquid stream, or the liquid water/hydrogenated liquid stream or steam/hydrogenated liquid stream mix at any or many points, and in a variety of fashions in the method of the present invention, so long as the heated water/hydrogenated liquid stream mix in line 150 has the conditions stipulated herein upon introduction to second flash drum 152. Alternatively, in another embodiment not shown in FIG. 1, steam and heated hydrogenated liquid stream, or steam and heated steam/hydrogenated liquid stream mix may be provided separately to second flash drum 152, provided that the heated water/hydrogenated liquid stream mix has the conditions stipulated herein within second flash drum 152.

Referring again to FIG. 1, the first flash vapor overhead stream in line 122 is provided to the inlet of coil 124 found in the lower radiant section of first pyrolysis furnace 106, where it is pyrolysis cracked such as at a temperature of typically between 700° C. (1300° F.) and 980° C. (1800° F.) at the exit of coil 124, creating a first pyrolysis effluent stream in line 128. Further, the second flash vapor overhead stream in line 154 is provided to the inlet of coil 156 found in the lower radiant section of a pyrolysis furnace, such as first pyrolysis furnace 108 or second pyrolysis furnace 138, where it is pyrolysis cracked to provide a temperature greater than about 700° C. (1300° F.) and less than about 980° C. (1800° F.) at the exit of coil 156, creating a second pyrolysis effluent stream containing ethylene and propylene that is passed into line 160.

In FIG. 1, a first portion of the second flash liquid bottoms stream in line 153 may be directed via line 158 to provide fuel for use in a pyrolysis furnace 138. The combustion of the first portion, or substantially all, of second flash liquid bottoms in line 158 in the appropriate elements of second pyrolysis furnace 138, for example, combustion burners (not shown in FIG. 1), provides heat for the hydrogenated liquid stream in coil 140, the steam generation from liquid water in coil 146 of the convective sections of second pyrolysis furnace 138, and heat to conduct pyrolysis cracking of the flash vapor overhead in coil 156 of the radiant section of second pyrolysis furnace 138. In addition, a another portion or substantially all of the second flash bottoms liquid stream in line 153 may be directed via line 162 to be combusted as fuel in utility system 196 to be utilized as needed in the overall process 100 of producing the pyrolysis effluent stream 128, 164 and recovering products such as ethylene and propylene.

In another aspect of the present invention, the first pyrolysis cracking effluent in line 128 and second pyrolysis cracking effluent in line 160 are combined in line 164, and the combined pyrolysis cracking effluent in line 164 is provided to a recovery system 166. In recovery system 166, the ethylene and propylene and other various components found in the combined pyrolysis cracking effluent in line 164 are separated. Recovery system 166 may provide, for example, a purified ethylene product in line 168, a purified propylene product in line 170, and a recovery byproduct stream in line 172. These product and recovery byproduct streams are fit for use by and/or sale to other processes, and exit through boundary 102 of the overall process 100 of producing and recovering the pyrolysis effluent stream. Recovery section 166 may comprise any number of equipment items and unit operations required to separate and purify various constituents of the pyrolysis effluent into various streams that are well known to those skilled in the arts such as olefin production. These include, but are not limited to, primary fractionators, quench pump-around towers, compressors, pumps, flash drums, heat exchangers, wash and absorber columns, fractional distillation columns, adsorbent beds for such purposes as drying. In addition, recovery section 166 may comprise reactors and sub-processes for such tasks as removing heteroatoms such as sulfur, or partially or fully saturating certain acetylenic, diolefinic, olefinic or aromatic molecules, that require reaction with hydrogen. Recovery byproducts are well known to those skilled in the art of olefin generation, and may be exported out of boundary 102 or otherwise provided to appropriate dispositions within boundary 102. They include such materials as LPG, butenes, pentenes, steam cracked naphtha, and steam cracked gas oil, among a host of other possibilities, and by way of example, steam cracked gas oil may be provided to utility system 166 for use as a fuel, or a portion of steam cracked gas oil may be recycled to a hot oil quench system associated with cooling pyrolysis cracked effluent. In addition, other materials may be provided to recovery system 166 as needed for its proper operation not shown in FIG. 1, such as cooling water and dosing chemicals.

Note that in an embodiment of the present invention not shown in FIG. 1, heat may be removed from the hot first pyrolysis cracking effluent in line 128, and from the hot second pyrolysis cracking effluent in line 160, prior to being introduced to recovery system 166. The methods to remove heat from these streams is known to those skilled in the art and may involve techniques, for example, known as hot oil quenching, or the generation of steam in Transfer Line Exchangers (TLE), among others, providing a much cooler, more tractable pyrolysis cracking effluent to recovery system 166. Such heat or steam as may be generated by such techniques may be utilized to meet the heat and energy requirements in the overall process 100.

Recovery system 166 may also provide a first recovery tail gas stream 174 that, conveniently, is low in hydrogen content, or potentially with no hydrogen at all, for example, a methane rich stream obtained from a demethanizer fractionation tower. In addition, recovery system 166 may recover and separate from the combined pyrolysis cracking effluent of line 164 a steam cracked tar stream 178 that may be provided to a partial oxidation system 180 for use therein to form a synthesis gas. Partial oxidation system 180 may comprise an air separation unit to provide purified oxygen from ubiquitous atmospheric air for use in the partial oxidation system 180 to provide a synthesis gas stream in line 184. At least a portion of the synthesis gas may be consumed as fuel in the system 100 such as to provide thermal energy for use in the process of cracking the hydrocarbon feedstock 104. For example, a portion of synthesis gas in line 184 may be directed via line 186 for combination with the first recovery tail gas stream in line 174, and the combined syngas and first recovery tail gas streams directed in line 126 to provide fuel for use in first pyrolysis furnace 106. Combustion of the gas streams of line 126 in the appropriate elements of a pyrolysis furnace 106, for example, combustion burners (not shown in FIG. 1), provides heat for the feedstock in coil 108 and steam generation from liquid water in coil 114, and heat to conduct pyrolysis cracking of the first flash vapor overhead in coil 124 of the radiant section of pyrolysis furnace 106. A portion of the synthesis gas from line 184 also may be fed to a hydrogen recovery unit 192 for recovery of hydrogen from the synthesis gas.

In another aspect of the invention, partial oxidation system 180 may comprise a water-gas shift sub-system to increase the hydrogen content of the syngas in line 184. The water-gas shift reaction, generally conducted over a nickel containing catalyst, converts CO and water contained in the synthesis gas that is within the partial oxidation system 180 to hydrogen and carbon dioxide, and upon removal of the produced carbon dioxide from the water-gas shift reaction product, provides a higher hydrogen content syngas.

Partial oxidation system 180 also produces byproducts that are disposed via line 182. Such byproducts are known to those skilled in the art of partial oxidation systems, and in such lines as they may be present, they may exported out of system 102 or otherwise provided to appropriate dispositions within system 102. These byproducts may include such materials as pressurized air, concentrated nitrogen, concentrated carbon dioxide, concentrated hydrogen sulfide, concentrated elemental sulfur, and fused slag, among a host of other possibilities. By way of example, the concentrated nitrogen may be distributed throughout the overall process of making ethylene and propylene 100 for such things as inert blanketing of tanks containing hydrocarbons. The pressurized air may be distributed throughout the overall process of making ethylene and propylene 100 for the operation of instrumentation and automated flow control valves. A concentrated carbon dioxide stream may be exported through system boundary 102 to be used for tertiary oil recovery by appropriately injecting it into a producing oil well, and fused slag may be exported from system 100 for use as aggregate in the manufacture of concrete. In addition, other materials may be provided to partial oxidation system 180 as needed for its proper operation not shown in FIG. 1, such as cooling water, dosing chemicals and the like, without departing from the method of the present invention.

Recovery system 166 may also serve to separate from the combined pyrolysis cracking effluent in line 164 a second recovery tail gas stream in line 176 that, conveniently, is high in hydrogen content, for example, a hydrogen rich stream obtained from what is generally termed in the art a cold box. A portion of this second recovery tail gas stream in line 176 may be directed into line 190 and introduced to a hydrogen recovery unit 192. Another portion of syngas in line 184 may be directed into line 188 and introduced into hydrogen recovery unit 192. Hydrogen recovery unit 192 may produce a hydrogen enriched stream in line 135 that is supplied to the hydrogenation system 132 for use therein in hydrogenating the first bottoms liquid stream 130. In many embodiments, the hydrogen recovery unit 192 may recover sufficient hydrogen from the pyrolysis effluent stream 164 so as to provide at least 75 wt % of the hydrogen consumed by the hydrogenation unit 132 in hydrogenating the first bottoms liquid stream 130.

In another embodiment, a significant portion or even substantially all of the hydrogen required in the overall system 100 may be recovered from hydrogen generated within system boundary 102. This may include, for example, recovery of hydrogen from one or more streams such as synthesis gas produced in partial oxidation system 180, one or more tails gases produced in recovery system 166, and a purge stream comprised mainly of unreacted hydrogen and light hydrocarbons from hydrogenation system 132. In such embodiments, no hydrogen rich streams are imported across boundary 102 into system 100. In an alternative aspect, the only hydrogen containing streams utilized for recovery to satisfy all of the hydrogen required in the overall system 100 include one or more of a synthesis gas produced in partial oxidation system 180, one or more tails gases produced in recovery system 166, and a purge stream comprised mainly of unreacted hydrogen and light hydrocarbons from hydrogenation system 132. In that aspect, no other systems are present within boundary 102 to create hydrogen and there are no other feed or fuel streams imported for such systems, for example, there is no methane imported into and no steam methane reformer present with boundary 102. While not shown in FIG. 1, elements of the overall system 100 that use such hydrogen may include but are not limited to the hydrogenation of at least a portion of a first bottoms liquid flash stream, partial or full saturation of acetylenes and diolefins found in or separated from the pyrolysis cracking effluent, partial or full saturation of $C_4$+ olefins found in or separated from the pyrolysis cracking effluent, or the removal of sulfur found in the pyrolysis cracking effluent or in olefin rich, aromatics rich, or fuel liquid streams separated therefrom.

Hydrogen recovery unit 192 also produces a hydrogen tail gas stream in line 194, which may comprise unrecovered hydrogen and non-hydrogen components, for example, methane, that were separated from the hydrogen containing streams provided to hydrogen recovery unit 192. The hydrogen tail gas stream in line 194 along with a portion of the second recovery tail gas stream in line 195 may be provided for use as a fuel in utility system 196. Utility system 196 may comprise any number of equipment items and unit operations that further process byproduct streams from or that receive, make or distribute useful utility streams for use in, the overall system 100.

Utility system 196 may receive a number of fuel streams as noted previously, including the materials of line 134 that were removed from hydrogenation system 132, a portion of the second flash liquid bottoms stream in line 162, the hydrogen tail gas stream in line 194, and a portion of the second recovery tail gas stream in line 195. Utility system 196 may then use these fuel streams to generate and distribute electricity represented in line 197, and to generate and distribute steam represented in line 198, to equipment and unit operations within boundary 102 as may be needed in the overall process for making ethylene and propylene 100. In addition, utility system 196 may receive or produce and distribute a host of other useful utilities and materials represented in line 199, such as cooling water, boiler feed water, plant air, industrial water, firefighting water, plant nitrogen, dosing chemicals and the like. Such other useful utilities and materials may or may not require heat from fuel consumption or other sources within utility system 196 or otherwise within boundary 102.

In one embodiment not shown in FIG. 1, utility system 196 may comprise a gaseous fuel collection and distribution system, for example, taking in various gaseous fuel streams, blending them to a desired heat content and providing them for use by other equipment and unit operations within utility system 196, or otherwise within boundary 102. For example, utility system 196 may provide gaseous fuel to pyrolysis furnaces 106 and 138, or heating furnaces within hydrogenation system 132, or to a gas turbine driven air compressor within partial oxidation system 180. An analogous collection and distribution system may also be a part of utility system 196 for liquid fuel streams.

Utility system 196 may also contain elements that combust the fuel streams that it may receive. By way of non-limiting examples, these may include a boiler that produces steam, a furnace that produces hot oil, a turbine generator that produces one or more of the group selected from electricity, steam, hot flue gas for other heating purposes, and drive energy, for example, that supplies shaft horsepower to pumps and compressors. Such shaft horsepower may be used for pumps and compressors considered within utility system 196, for example, for pumping cooling water from cooling towers within utility system 196 to other users within utility system 196 or to condenser heat exchangers in recovery system 166. Alternatively, such shaft horsepower may be tied directly to compressors and pumps outside of utility system 196, for example, to drive an air compressor found in partial oxidation system 180, rather supplying fuel to a gas turbine driver for an air compressor within partial oxidation system 180.

Such steam produced by any means within utility system 196 or within boundary 102, may be utilized in the overall process 100. Elements of the overall process 100 that use such steam may include, but are not limited to, dilution steam for the hydrocarbon feed to a pyrolysis furnace, turbine generators/expanders to produce electricity, turbines/expanders as a mover of pumps and compressors, reboilers of fractionation towers, evaporators of desalination water production units, cold weather tracing, and other elements required to produce olefins in a safe and environmentally acceptable manner.

The precise area or system within boundary 102 where fuel consumption takes place is not critical to the method of the present invention, and to those skilled in the art of chemical process engineering, the exact purpose and location of fuel consumers, and heat and power generators and users is fluid, and a matter of preference for any given process and configuration. In one embodiment of the invention, fuel, heat and power is generated only within and consumed only within boundary 102. In various aspects, a significant proportion, or even all of the fuel, heat, and power required in the overall process 100 is generated and consumed within boundary 102, which is to say, much or all of the fuel required in the overall process 100 is provided as a portion of, or conveniently a process derivative of the feedstock(s) 104 that may be provided to a pyrolysis furnace for cracking. In the particular aspect when the proportion is substantially 100%, the only hydrocarbon crossing into boundary 102 is the feedstock(s) 104 and all fuel, heat, and energy required in the overall process 100 is generated by combusting a portion of or a process derivative of the feedstock 104 and no other fuel or energy intensive streams imported into boundary 102.

Other embodiments of the invention may include:

1. A process for cracking a hydrocarbon feedstock comprising:
   a) feeding a hydrocarbon feedstock containing at least 1 wt % of resid fractions having end boiling points of at least 500° C. to a furnace convection section to heat the feedstock;
   b) flashing the heated feedstock in a first flash separation vessel to create a first overhead stream and a first bottoms liquid stream;
   c) hydrogenating at least a portion of the first bottoms liquid stream to create a hydrogenated bottoms stream;
   d) flashing the hydrogenated bottoms stream in a second flash separation vessel to create a second overhead stream and a second bottoms liquid stream;
   e) cracking the first overhead stream and the second overhead stream in a cracking furnace to produce a pyrolysis effluent stream.
2. The process of paragraph 1, further comprising the step of heating the hydrocarbon feedstock in step a) to a temperature within a range of from 315° C. to 705° C.
3. The process of paragraph 1, further comprising the step of adding steam and/or water to at least one of the hydrocarbon feedstock and the hydrogenated bottoms stream.
4. The process of paragraph 1, further comprising the step of heating the hydrogenated bottoms stream to a temperature within a range of from 315° C. to 705° C. prior to flashing the heated hydrogenated bottoms stream.
5. The process of paragraph 1, wherein the hydrogenating step c) consumes from at least 100 SCF (0.01689 NCM/liter) up to not greater than 1500 SCF (0.25333 NCM/l) of hydrogen per barrel of first bottoms liquid stream.
6. The process of paragraph 1, wherein the difference in hydrogen content of the first flash bottoms liquid stream from step b) and the hydrogen content of the hydrogenated bottoms stream of step c) is in the range of from at least 0.5 wt % up to not greater than 3.0 wt %.
7. The process of paragraph 1, further comprising consuming at least a portion of the second bottoms liquid as fuel that supports at least one of steps a) through e).
8. The process of paragraph 1, further comprising:
   recovering steam cracked tar from the pyrolysis effluent stream;
   partially combusting at least a portion of a recovered steam cracked tar in a partial oxidation process to form a synthesis gas.
9. The process of paragraph 8, further comprising consuming at least a portion of said synthesis gas as fuel that supports at least one of steps a) through e).
10. The process of paragraph 8, further comprising feeding at least a portion of said synthesis gas to a hydrogen recovery unit.
11. The process of paragraph 10, further comprising recovering a hydrogen enriched stream from the hydrogen recovery unit and supplying at least a portion of the hydrogen enriched stream to the hydrogenating step c).
12. The process of paragraph 1, further comprising
   recovering the pyrolysis effluent stream;
   recovering a hydrogen rich stream from the pyrolysis effluent stream; and
   supplying at least 75 wt % of hydrogen consumed in hydrogenating step c) with said hydrogen rich stream.

13. The process of any of the preceding paragraphs, performed using a steam cracking apparatus for cracking a hydrocarbon feedstock, the apparatus comprising:
   a) a furnace convection section to heat a hydrocarbon feedstock containing resid;
   b) a first flash separation vessel to flash the heated hydrocarbon feedstock to create a first overhead stream and a first bottoms liquid stream;
   c) a hydrogenation unit to hydrogenate at least a portion of the first bottoms liquid stream to create a hydrogenated bottoms stream;
   d) another flash separation vessel to flash the heated hydrogenated bottoms stream to create a second overhead stream and a second bottoms liquid stream;
   e) a cracking furnace to crack the first overhead stream and the second overhead stream to produce a pyrolysis effluent stream.
14. The apparatus of paragraph 13, further comprising at least one of said furnace convection section and another furnace convection section to heat said hydrogenated bottoms stream from said hydrogenation unit.
15. The apparatus of paragraph 13, further comprising a partial oxidation unit to partially combust at least a portion of a steam cracked tar recovered from said pyrolysis effluent stream to form a synthesis gas.
16. The apparatus of paragraph 15, further comprising a hydrogen recovery unit to recover hydrogen from said partial oxidation unit and utilizing at least a portion of said recovered hydrogen in said hydrogenation unit.
17. The apparatus of paragraph 15, further comprising a thermal generation system to combust at least a portion of said produced synthesis gas to provide thermal energy for use in cracking said hydrocarbon feedstock.

While the present invention has been described and illustrated with respect to certain embodiments, it is to be understood that the invention is not limited to the particulars disclosed and extends to all equivalents within the scope of the claims.

The invention claimed is:

1. A process for cracking a hydrocarbon feedstock comprising:
   a) obtaining a hydrocarbon feedstock containing at least 1 wt % of resid fractions having boiling points of at least 500° C., wherein the feedstock includes at least one component selected from the group consisting of crude oil, atmospheric resids, contaminated condensate, gas oil distillates, tars, steam cracker tars, fuel oils, quench tower bottoms, and cycle oils;
   b) feeding the hydrocarbon feedstock directly to a furnace convection section to heat the feedstock;
   c) flashing the heated feedstock in a first flash separation vessel to create a first overhead stream and a first bottoms liquid stream;
   d) hydrogenating at least a portion of the first bottoms liquid stream to create a hydrogenated bottoms stream;
   e) flashing the hydrogenated bottoms stream in a second flash separation vessel to create a second overhead stream and a second bottoms liquid stream; and
   f) cracking the first overhead stream and the second overhead stream in a cracking furnace to produce a pyrolysis effluent stream.

2. The process of claim 1, further comprising the step of heating the hydrocarbon feedstock in step a) to a temperature within a range of from 315° C. to 705° C.

3. The process of claim 1, further comprising the step of adding steam and/or water to at least one of the hydrocarbon feedstock and the hydrogenated bottoms stream.

4. The process of claim 1, further comprising the step of heating the hydrogenated bottoms stream to a temperature within a range of from 315° C. to 705° C. prior to flashing the heated hydrogenated bottoms stream.

5. The process of claim 4, further comprising feeding the hydrogenated bottoms stream to a furnace convection section to heat the hydrogenated bottoms stream.

6. The process of claim 1, wherein the hydrogenating step c) consumes from at least 100 SCF up to not greater than 1500 SCF of hydrogen per barrel of first bottoms liquid stream.

7. The process of claim 1, wherein the difference in hydrogen content of the first flash bottoms liquid stream from step b) and the hydrogen content of the hydrogenated bottoms stream of step c) is in a range of from at least 0.5 wt % up to not greater than 3.0 wt %.

8. The process of claim 1, wherein the furnace comprises a steam cracking furnace.

9. The process of claim 1, further comprising consuming at least a portion of the second bottoms liquid stream as fuel that supports at least one of steps a) through e).

10. The process of claim 1, further comprising:
   recovering steam cracked tar from the pyrolysis effluent stream;
   partially combusting at least a portion of a recovered steam cracked tar in a partial oxidation process to form a synthesis gas.

11. The process of claim 10, further comprising consuming at least a portion of said synthesis gas as fuel that supports at least one of steps a) through e).

12. The process of claim 10, further comprising feeding at least a portion of said synthesis gas to a hydrogen recovery unit.

13. The process of claim 12, further comprising recovering a hydrogen enriched stream from the hydrogen recovery unit and supplying at least a portion of the hydrogen enriched stream to the hydrogenating step c).

14. The process of claim 1, further
   comprising recovering the pyrolysis effluent stream;
   recovering a hydrogen rich stream from the pyrolysis effluent stream; and
   supplying at least 75 wt % of hydrogen consumed in hydrogenating step c) with said hydrogen rich stream.

15. The process of claim 1, wherein the hydrocarbon feedstock of step a) comprises at least about 5 wt % of components boiling at or above 340° C. according to ASTM D2887.

16. A process for cracking a hydrocarbon feedstock comprising:
   a) feeding a hydrocarbon feedstock containing at least 2 wt % of fractions having boiling points of at least 500° C., wherein the feedstock includes at least one component selected from the group consisting of crude oil, atmospheric resids, contaminated condensate, gas oil distillates, tars, steam cracker tars, fuel oils, quench tower bottoms, and cycle oils, to a furnace convection section to heat the feedstock prior to hydrotreating, hydrogenating, hydroprocessing, or solvent-deasphalting the feedstock;
   b) flashing the heated feedstock in a first flash separation vessel to create a first overhead stream and a first bottoms liquid stream;
   c) hydrogenating at least a portion of the first bottoms liquid stream to create a hydrogenated bottoms stream;
   d) heating the hydrogenated bottoms stream;
   e) flashing the heated hydrogenated bottoms stream in a second flash separation vessel to create a second overhead stream and a second bottoms liquid stream;

f) cracking the first overhead stream and the second overhead stream in a cracking furnace to produce a pyrolysis effluent stream;

g) recovering steam cracked tar from the pyrolysis effluent stream;

h) partially combusting at least a portion of a recovered steam cracked tar in a partial oxidation process to form a synthesis gas; and i) recovering hydrogen from said synthesis gas and utilizing at least a portion of said recovered hydrogen in step c) hydrogenation.

17. The process of claim 16, further comprising combusting at least a portion of said synthesis gas produced in step h) to provide thermal energy for use in the process of cracking a hydrocarbon feedstock.

18. The process of claim 16, further comprising feeding the hydrogenated bottoms stream to a furnace convection section to heat the hydrogenated bottoms stream to a temperature in a range of from 315° C. to 705° C.

19. The process of claim 16, wherein the difference in hydrogen content of the first flash bottoms liquid stream from step b) and the hydrogen content of the hydrogenated bottoms stream of step c) is within a range of from at least 0.5 wt % up to not greater than 3.0 wt %.

20. A process for cracking a hydrocarbon feedstock comprising:

a) feeding a hydrocarbon feedstock having a hydrogen content according to ASTM D4808 of no greater than 14.0 wt % and containing at least 1 wt % of resid fractions having boiling points of at least 500° C. to a furnace convection section to heat the feedstock;

b) flashing the heated feedstock in a first flash separation vessel to create a first overhead stream and a first bottoms liquid stream;

c) hydrogenating at least a portion of the first bottoms liquid stream to create a hydrogenated bottoms stream;

d) flashing the hydrogenated bottoms stream in a second flash separation vessel to create a second overhead stream and a second bottoms liquid stream; and e) cracking the first overhead stream and the second overhead stream in a cracking furnace to produce a pyrolysis effluent stream.

21. The process of claim 20, wherein the hydrocarbon feedstock includes at least one component selected from the group consisting of crude oil, atmospheric resids, contaminated condensate, gas oil distillates, tars, steam cracker tars, fuel oils, quench tower bottoms, and cycle oils.

22. The process of claim 20, wherein the feeding of step a) occurs prior to hydrotreating, hydrogenating, hydroprocessing, or solvent-deasphalting the feedstock.

* * * * *